US006210528B1

(12) United States Patent
Wolkowicz

(10) Patent No.: US 6,210,528 B1
(45) Date of Patent: Apr. 3, 2001

(54) PROCESS OF MAKING WEB-CREPED IMPRINTED PAPER

(75) Inventor: Richard Ignatius Wolkowicz, Cumming, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/468,559

(22) Filed: Dec. 21, 1999

Related U.S. Application Data

(60) Provisional application No. 60/113,172, filed on Dec. 21, 1998.

(51) Int. Cl.[7] ..... D21H 27/02; D21F 11/00

(52) U.S. Cl. ..... 162/111; 162/109; 162/117; 162/205; 428/153; 156/183; 264/283

(58) Field of Search ..... 162/109, 111, 162/116, 117, 204, 205; 428/153, 154, 198, 211; 156/183; 264/283, 284

(56) References Cited

U.S. PATENT DOCUMENTS

| | | | |
|---|---|---|---|
| Re. 25,335 | 2/1963 | Hamilton | 162/113 |
| Re. 28,459 | 7/1975 | Cole et al. | 34/6 |
| 2,996,425 | 8/1961 | Hamilton | 162/113 |
| 3,072,522 | 1/1963 | Hornbostel | 162/113 |
| 3,104,197 | 9/1963 | Back et al. | 162/113 |
| 3,164,512 | 1/1965 | Dixson et al. | 162/112 |
| 3,301,746 | 1/1967 | Sanford et al. | 162/113 |
| 3,432,936 | 3/1969 | Cole et al. | 34/6 |
| 3,615,976 | 10/1971 | Endres et al. | 156/83 |
| 3,974,025 | 8/1976 | Ayers | 162/113 |
| 3,994,771 | 11/1976 | Morgan, Jr. et al. | 162/113 |
| 4,087,319 | 5/1978 | Linkletter | 162/113 |
| 4,125,659 | 11/1978 | Klowak et al. | 428/153 |
| 4,166,001 | 8/1979 | Danning et al. | 162/111 |
| 4,300,981 | 11/1981 | Carstens | 162/109 |
| 4,420,372 | 12/1983 | Hostetler | 162/280 |
| 4,421,600 | 12/1983 | Hostetler | 162/111 |
| 4,440,597 | 4/1984 | Wells et al. | 162/111 |
| 4,529,480 | 7/1985 | Trokhan | 162/109 |
| 4,551,199 | 11/1985 | Weldon | 162/109 |
| 4,610,743 * | 9/1986 | Salmeen et al. | 156/183 |
| 4,689,119 | 8/1987 | Weldon | 162/281 |

(List continued on next page.)

FOREIGN PATENT DOCUMENTS

| | | |
|---|---|---|
| 1 176 886 | 10/1984 | (CA) . |
| 718 436A2 | 6/1996 | (EP) . |
| 2006296 | 5/1979 | (GB) . |
| 2 098 637 | 11/1982 | (GB) . |
| 93/00475 | 1/1993 | (WO) . |
| 97/47809 | 12/1997 | (WO) . |
| 98/00604 | 1/1998 | (WO) . |

*Primary Examiner*—Peter Chin
*Assistant Examiner*—José A. Fortuna
(74) *Attorney, Agent, or Firm*—Karl V. Sidor

(57) ABSTRACT

A low density, wet-creped paper web having improved levels of tensile strength, tear strength and thickness. The web has a distribution of densified regions corresponding to the distribution of knuckles on a drying fabric. Generally speaking, these densified regions should be distributed so that the distance between at least a portion of the densified regions is less than or equal to the length of the longest fiber in the furnish (e.g., pulp fibers and/or other fibers) used to make the paper web. The wet-creped paper web is removed from a Yankee dryer at a dryness of between 45 and 65% and then passed to the after dryer section of a paper machine. An after dryer fabric is pressed into the wet base web to transfer the topography of the after dryer fabric to the web and to generate improved tensile strength, tear strength and thickness. The wet base web is pressed into the drying fabric utilizing a nip before the web is 70% dry. Once the wet base web initially contacts the drying fabric, it should remain on the drying fabric without any change in the registration between the wet base web and the drying fabric until the base web is at least about 80% dry.

12 Claims, 2 Drawing Sheets

U.S. PATENT DOCUMENTS

| | | | |
|---|---|---|---|
| 4,849,054 | 7/1989 | Klowak | 162/109 |
| 4,894,118 | 1/1990 | Edwards et al. | 162/112 |
| 4,992,140 | 2/1991 | Anderson et al. | 162/111 |
| 5,215,626 | 6/1993 | Ampulski et al. | 162/112 |
| 5,223,092 | 6/1993 | Grinnell et al. | 162/109 |
| 5,328,565 | 7/1994 | Rasch et al. | 162/113 |
| 5,429,686 | 7/1995 | Chiu et al. | 139/383 |
| 5,431,786 | 7/1995 | Rasch et al. | 162/348 |
| 5,500,277 | 3/1996 | Trakhan et al. | 428/196 |
| 5,598,643 | 2/1997 | Chuang et al. | 34/406 |
| 5,614,061 | 3/1997 | Van Phan et al. | 162/109 |
| 6,106,670 * | 8/2000 | Weisman et al. | 162/109 |

* cited by examiner

PROCESS OF MAKING WEB-CREPED IMPRINTED PAPER

This application claims benefit of Provisional 60/113,172, filed Dec. 21, 1998.

FIELD OF THE INVENTION

The present invention relates generally to wet-creped webs for towel and tissue and, more particularly to methods for making wet-creped webs having an imprinted pattern.

SUMMARY OF THE INVENTION

It is an object of the present invention to provide a low density paper base web for towels and tissues from a wet-creped web as well as a process for making such a web.

It is a further object of the present invention to provide a low density paper based web with improved tensile strength, tear strength and thickness as well as a process for making such a web.

It is a feature of the present invention to provide a low density paper base web having a pattern of densifications therein wherein fines are concentrated in the densifications as well as a process for making such a web.

Another feature of the present invention is to provide a low density paper base web for towels and tissues having a pattern of densifications therein wherein chemicals added to the furnish are concentrated on one surface of the finished web and particularly, on one surface of the densifications. It is also a feature of the present invention to provide a process for drying a low density paper base web for towels and tissues having a pattern of densifications therein wherein chemicals added to the furnish are caused to migrate and thereby concentrate on one surface of the finished web and particularly, on one surface of the densifications.

Briefly stated, these and numerous other features, objects and advantages of the present invention will become readily apparent upon a reading of the detailed description, claims and drawings set forth herein.

According to the invention, a wet-creped paper web is removed from a Yankee dryer at a dryness of between 45 and 65%. Desirably, the wet-creped paper web is removed at a dryness ranging from about 50 to about 60%. The web is then passed to the after dryer section of the paper machine.

A feature of the invention is to press an after dryer fabric into the wet base web to transfer the topography of the after dryer fabric to the web and to generate improved tensile strength, tear strength and thickness.

The wet base web is pressed into the drying fabric utilizing a nip before the web is 70% dry. Desirably, this pressing step occurs at a web dryness ranging from about 45 to about 65%. More desirably, this pressing step occurs at a web dryness ranging from about 50 to about 60%.

Pressing the wet base web into the drying fabric may be accomplished utilizing a hard press roll such as a steel roll which is backed by a soft roll such as a rubber roll. That is, the steel roll contacts the after dryer fabric and presses the after dryer fabric into the base web which is backed or supported by the rubber roll. Alternatively, a soft press roll (e.g., rubber press roll) may contact the after dryer fabric and press the after dryer fabric into the base web which is backed or supported by a hard roll (e.g., steel roll). In yet another alternative, a soft press roll (e.g., rubber press roll) may be used to contact the after dryer fabric and press the after drying fabric into the base web which is supported by a drying can such as, for example, a Yankee dryer, heated drum and/or steam can. In such an embodiment, the drying can will need to be sufficiently robust to support the load of the press roll. The load on the rolls may be varied to obtain the desired conformation of the web to the wire so that the topography of the wire is transferred to the web. Desirably, this transfer of the wire topography to the web will be substantial.

As an example, the load on the rolls may be sufficient to produce a pressure at the nip of from about 10 to about 400 pounds per square inch. As a further example, the load on the rolls may be sufficient to produce a pressure at the nip of from about 15 to about 100 pounds per linear inch. As a further example, the load on the rolls may be sufficient to produce a pressure at the nip of from about 20 to about 50 pounds per linear inch.

According to the invention, once the wet base web initially contacts the drying fabric, it should remain on the drying fabric without any change in the registration between the wet base web and the drying fabric until the base web is at least about 80% dry. Desirably, the wet base web should remain on the drying fabric until it is about 95% dry.

In one embodiment of the invention, a drying can or series of drying cans may be used to dry the wet base web. The terms "can drying" and "drying cans" are used herein to refer to and include Yankee dryers and other rotating, solid surface, heated drums such as, for example, steam cans, gas fired or electrically heated drums. An after drying fabric is used to hold the web against the drying cans. The after drying fabric may be threaded in a mode or configuration wherein the web and fabric contact and registration are maintained until the web is substantially dry (e.g., at least about 80% dry). Generally speaking, the term "dry" or "dryness" refers to an average dryness of the web at the point of measurement and is a ratio of the bone dry fiber weight to the total web weight (fibers and water) at the point of measurement. Desirably, a single drying fabric may be used to carry the web. In such an embodiment, the fabric may traverse the drying cans in a serpentine pattern such that the web contacts the drying fabric and stays in contact with the drying fabric until the web is substantially dry.

The present invention encompasses a low density, wet-creped paper web having improved levels of tensile strength, tear strength and thickness made according to the process described above.

In an embodiment, the low density, wet-creped paper web has a distribution of densified regions corresponding to the distribution of knuckles on the drying fabric. Generally speaking, these densified regions should be distributed so that the distance between at least a portion of the densified regions is less than or equal to the length of the longest fiber in the furnish (e.g., pulp fibers and/or other fibers) used to make the paper web. Desirably, these densified regions should be distributed so that the distance between at least a portion of the densified regions is less than the average fiber length of the furnish (e.g., pulp fibers and/or other fibers) in the furnish used to make the paper web.

The densified regions will generally have improved strength and will enhance the overall strength of the paper web. The portions of the paper web outside the densified regions will generally have lower to much lower densities. Such low density regions generally provide good water or liquid absorption.

DEFINITIONS

Figure 1:
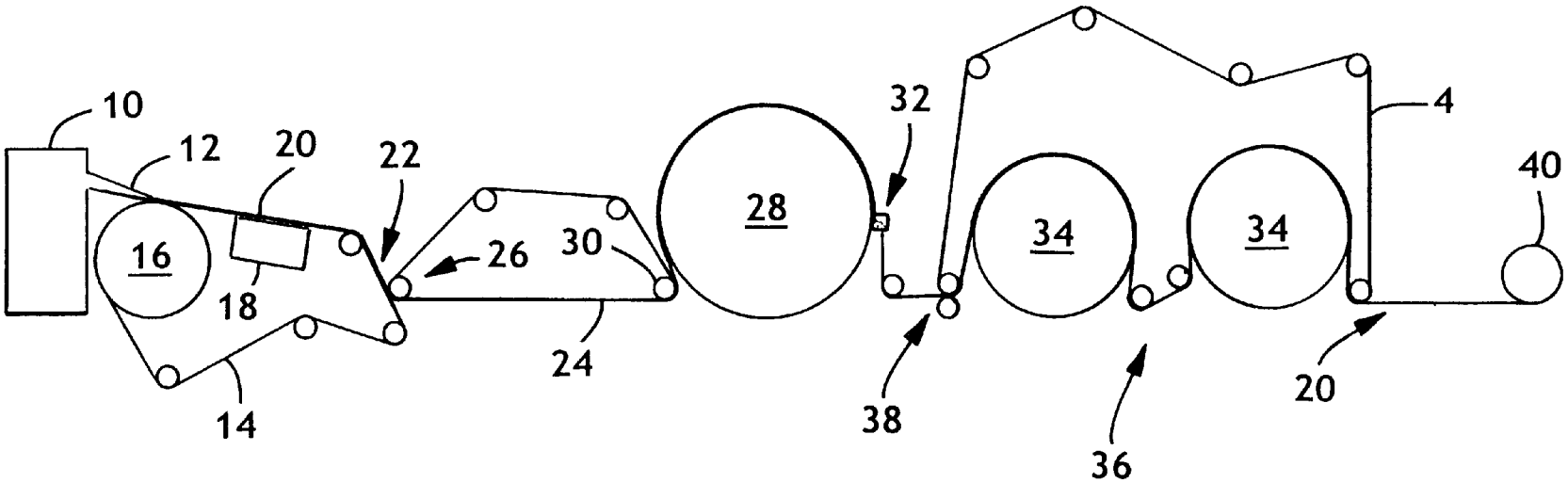
FIG. 1 is an illustration of an exemplary papermaking apparatus.

The term "average fiber length" as used herein refers to a weighted average length of pulp fibers determined utilizing a Kajaani fiber analyzer model No. FS-100 available from Kajaani Oy Electronics, Kajaani, Finland. According to the test procedure, a pulp sample is treated with a macerating liquid to ensure that no fiber bundles or shives are present. Each pulp sample is disintegrated into hot water and diluted to an approximately 0.001% solution. Individual test samples are drawn in approximately 50 to 100 ml portions from the dilute solution when tested using the standard Kajaani fiber analysis test procedure. The weighted average fiber length may be expressed by the following equation:

$$\sum_{x_i=0}^{k}(x_i * n_i)/n$$

where k=maximum fiber length $x_i$=fiber length $n_i$=number of fibers having length $x_i$ n=total number of fibers measured.

The term "low-average fiber length pulp" as used herein refers to pulp and by-products of paper-making processes that contains a significant amount of short fibers and non-fiber particles. In many cases, these material may be difficult to form into paper sheets and may yield relatively tight, impermeable paper sheets or nonwoven webs. Low-average fiber length pulps may have an average fiber length of less than about 1.2 mm as determined by an optical fiber analyzer such as, for example, a Kajaani fiber analyzer model No. FS-100 (Kajaani Oy Electronics, Kajaani, Finland). For example, low average fiber length pulps may have an average fiber length ranging from about 0.6 to 1.2 mm. Generally speaking, most of the fibrous or cellulosic components of paper-making sludge may be considered low average fiber length pulps (short fibers and non-fiber particles).

The term "high-average fiber length pulp" as used herein refers to pulp that contains a relatively small amount of short fibers and non-fiber particles which may yield relatively open, permeable paper sheets or nonwoven webs that are desirable in applications where absorbency and rapid fluid intake are important. High-average fiber length pulp is typically formed from non-secondary (i.e., virgin) fibers. Secondary fiber pulp which has been screened may also have a high-average fiber length. High-average fiber length pulps typically have an average fiber length of greater than about 1.5 mm as determined by an optical fiber analyzer such as, for example, a Kajaani fiber analyzer model No. FS-100 (Kajaani Oy Electronics, Kajaani, Finland). For example, a high-average fiber length pulp may have an average fiber length from about 1.5 mm to about 6 mm. Exemplary high-average fiber length pulps which are wood fiber pulps include, for example, bleached and unbleached virgin softwood fiber pulps.

The term "pulp" as used herein refers to cellulose containing fibers from natural sources such as woody and non-woody plants. Woody plants include, for example, deciduous and coniferous trees. Non-woody plants include, for example, cotton, flax, esparto grass, milkweed, straw, jute hemp, and bagasse.

The term "permeability" as used herein refers to the ability of a fluid, such as, for example, a gas to pass through a material. Permeability may be expressed in units of volume per unit time per unit area, for example, (cubic feet per minute) per square foot of material (e.g., ($ft^3$/minute/$ft^2$) or (cfm/$ft^2$)).

The term "fines" as used herein refers fiber-like particles and non-fiber particles of about 0.4 mm or less in length as determined by an optical fiber analyzer such as, for example, a Kajaani fiber analyzer model No. FS-100 (Kajaani Oy Electronics, Kajaani, Finland). For example, fines may be primarily a fibrous or cellulosic material present in low-average fiber length pulp or high-average fiber length pulp. Fines may also include some portion of ash-generating material.

The term "ash generating materials" as used herein refers to components of a paper which generate inorganic residue which remains after igniting a specimen of wood, pulp, or paper so as to remove combustible and volatile compounds.

The term "paper-making sludge" as used herein refers to residue from conventional paper-making processes that contains a substantial proportion of both low-average fiber length pulp (i.e., short fibers and non-fiber particles) and ash-generating materials. The fibrous or cellulosic component of paper-making sludge may contain more than 70 percent, by weight, low-average fiber length pulp. For example, the fibrous or cellulosic component of paper-making sludge may contain more than 80 percent, by weight, low-average fiber length pulp.

DETAILED DESCRIPTION

Turning first to FIG. 1, there is shown an illustration of an exemplary papermaking process utilizing a wet-creping step. In the process, a head box 10 delivers a furnish 12 onto a forming fabric 14 wrapped around a vacuum breast roll 16. The furnish may be at a fiber consistency of from about 0.08% to about 0.6% and, more desirably, at a fiber consistency of from about 0.1% to about 0.5%, and most desirably at a fiber consistency of from about 0.1% to about 0.2%. Immediately after the vacuum breast roll 16, forming fabric 14 passes over the vacuum box 18 to further vacuum dewater the embryonic web 20.

It should be noted that the type of headbox 10 used is not critical to the practice of the method of the present invention. Any headbox which delivers a well-formed web may be employed. Further, although the embodiments discussed herein and depicted in FIG. 1 utilizes a vacuum breast roll, this too is not critical to the practice of the method of the present invention. The method may be used with breast roll formers, twin wire formers and fourdriniers, as well as variations thereof.

The forming fabric 14 then passes through a transfer zone 22 wherein the web 20 is transferred onto a carrier felt 24. The transfer is made with the help of a vacuum pickup roll or transfer shoe 26. The transfer of the web from forming fabric 14 to carrier felt 24 should be made when the web consistency is in the range of from about 18% to about 35% and is desirably in the range of from about 22% to about 32%.

The web is then transferred from the carrier felt 24 to a Yankee dryer 28 using a vacuum press roll 30. It is contemplated that other transfer mechanisms such as, for example, a transfer shoe, may be employed. The web 20 is then dried on the Yankee dryer 28 to a dryness ranging from about 45 to about 70% or more desirably, to a dryness ranging from about 45 to about 65%. The web is then creped from the Yankee dryer 28 utilizing conventional wet-creping equipment 32. The wet-creped web 24 then travels unsupported to the after drying section 36 of the paper machine.

The web 20 is transferred to the knuckled side of a drying fabric 44. The drying fabric 44 is then taken over a can dryer 34 such as a Yankee dryer or one or more heated drums (e.g., steam cans, gas fired drums, electrically heated drums or the like).

According to the invention, the wet web is pressed into a drying fabric 44 utilizing a nip roll arrangement 38 before the web is 70% dry. Desirably, this pressing step occurs at a web dryness ranging from about 45 to about 65%. More desirably, this pressing step occurs at a web dryness ranging from about 50 to about 60%

Figure 2:
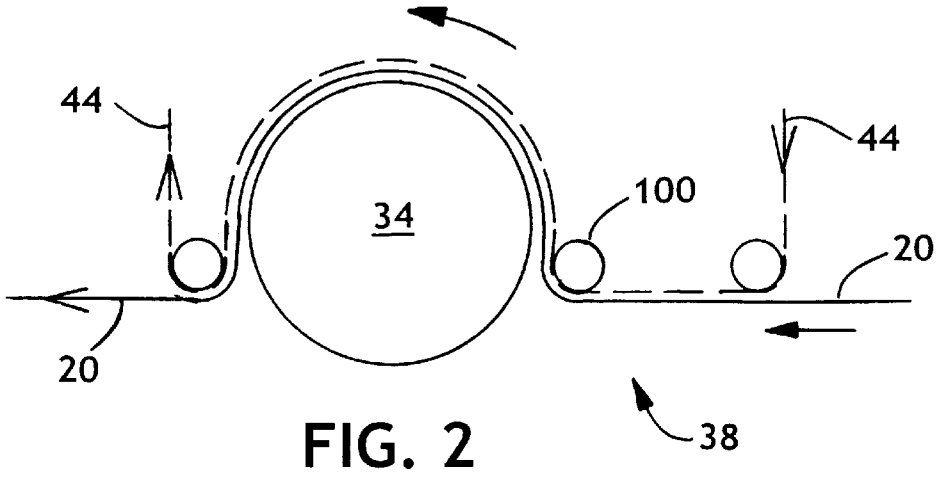
FIG. 2 is an illustration of a detail of an exemplary press roll and after dryer arrangement.

Referring now to FIG. 2, in one embodiment, a soft press roll (e.g., rubber press roll) 100 may be used to contact the after dryer fabric 44 and press the after drying fabric 44 into the base web 20 which is supported by a drying can 34 such as, for example, a Yankee dryer, heated drum and/or steam can. In such an embodiment, the drying can will need to be sufficiently robust to support the load of the press roll.

Figure 3:
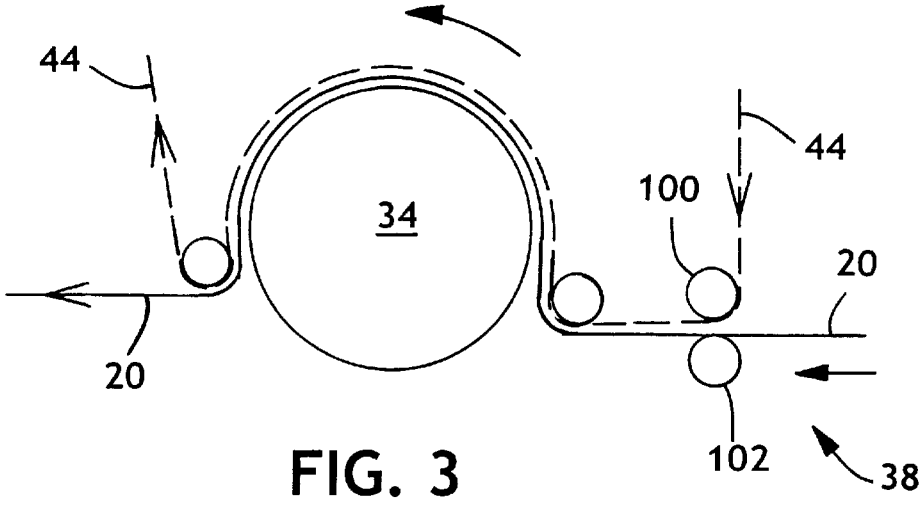
FIG. 3 is an illustration of a detail of an exemplary press roll and after dryer arrangement.

More desirably, pressing the wet base web 20 into the drying fabric 44 may be accomplished utilizing a soft press roll such as a rubber press roll which is backed by a hard roll such as a steel roll. Such an exemplary arrangement is illustrated in FIG. 3. Referring now to FIG. 3, there is shown a rubber press roll 100 that contacts the after dryer fabric 44 and presses the after dryer fabric 44 into the base web 20 which is backed or supported by a steel roll 102.

Figure 4:
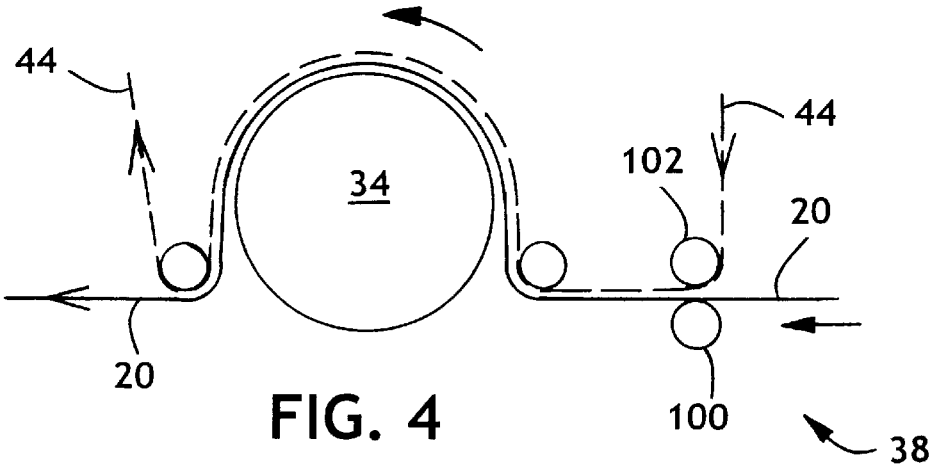
FIG. 4 is an illustration of a detail of an exemplary press roll and after dryer arrangement.

Most desirably, pressing the wet base web 20 into the drying fabric 44 may be accomplished utilizing a hard press roll such as a steel roll which is backed by a soft roll such as a rubber roll. Such an exemplary arrangement is illustrated in FIG. 4. Referring now to FIG. 4, there is shown a steel roll 102 that contacts the after dryer fabric 44 and presses the after dryer fabric 44 into the base web 20 which is backed or supported by a rubber roll 100.

The load on the rolls may be varied to obtain the desired conformation of the web to the wire so that the topography of the wire is transferred to the web. Desirably, this transfer of the wire topography to the web will be substantial.

As an example, the load on the rolls may be sufficient to produce a pressure at the nip of from about 10 to about 400 pounds per square inch. As a further example, the load on the rolls may be sufficient to produce a pressure at the nip of from about 15 to about 100 pounds per linear inch. As a further example, the load on the rolls may be sufficient to produce a pressure at the nip of from about 20 to about 50 pounds per linear inch.

In such manner, the knuckles of drying fabric 44 are pressed into the web 20 restraining the web 20 against non-registered movement in relation to the drying fabric 44. In other words, the web 20 is sandwiched between the drying fabric 44 and the can dryer 34 with the knuckles of the drying fabric 44 imprinting a pattern of densifications into the web 20. Because the drying fabric 44 includes recessions surrounding each knuckle, preferably only the knuckles press the web 20 against the can dryers 34. Desirably, upon leaving the after dryer cans 34, the web has reached a dryness of at least about 80% or more desirably from about 90% to about 97%. The webs may then be wound onto a reel 40.

The drying fabric 44 is an endless belt or wire with knuckles or protuberances projecting therefrom. As such, the drying fabric 44 can be a woven fabric, a punched film or sheet, a molded belt, or a fabric as taught in U.S. Pat. No. 4,529,480 to Trokhan. Exemplary drying fabrics include, but are not limited to, fabrics available under the designations Albany 5602 and Albany 121 from Albany International, Appleton Wire Division, Appleton, Wis.; and Asten Hill 36-F fabric available from Asten-Hill.

The drying fabric may be sanded to increase the area of the knuckles that press against the wet web. Desirably, the drying fabric is utilized with the long shute knuckle side against the wet web.

The dryer fabric 44 is a continuous or endless wire and thus travels over a series of guide rolls, through a drive roll section and through a tensioning roll section and back to the transfer zone 22.

As mentioned above, the dryer fabric 44 has a plurality of knuckles or protuberances arranged in a pattern and extending therefrom. The maximum spacing between the adjacent knuckles should be about equal to or less than the length of the longest fiber in the furnish 12. Most desirably, the maximum spacing between adjacent knuckles is equal to or less than the average fiber length in the furnish 12. Thus, since the present invention is directed primarily to making towel and tissue product in a range of basis weight from 8 to about 100 grams per square meter (gsm) (e.g., from about 5.6 to about 70 pounds per ream), using wood pulp furnishes typical to those types of product, the knuckle spacing between adjacent knuckles should be in the range of 2.5 millimeter or less. The area of the web 20 actually pressed by the knuckles is desirably in the range of 5% to 30% of the area of the web 20.

The drying fabric 44 selected depends on the properties desired in the product and the furnish being used. If higher bulk is desired, one would select a drying fabric 44 with large void spaces. This could be a coarse mesh fabric. On the other hand, if more strength were desired one could select a drying fabric 44 with more knuckles to press the web or one could sand the existing knuckles to create a larger press area. It can be envisioned that a limitless combination of geometries in woven fabrics and endless belts can be used to produce a large variety of web structures to meet specific product needs.

The wet-creping process creates machine-direction stretch in the web 20 and also generates a relatively low density web. A minimum disruption of this structure is maintained by the present invention through the maintenance of the web 20 on the drying fabric 44, and in registration therewith during drying to a critical dryness level, and preferably, through completion of the drying of the web 20.

It should be recognized that although the web 20 is pressed against the can dryers, ostensibly through fabric tension, the web is not dewatered by pressing. Because the web 20 remains in registration with the drying fabric 44 through the entire drying, the only pressing of the web 20 is at the knuckled areas of the drying fabric 44.

The base web formed in the process of the present invention has surprising strength for the thickness and density of the base web. This makes it highly suitable to make low basis weight towels and tissues without sacrificing quality.

The bulk or thickness of the base web made with the process of the present invention depends more on the fabric selected than the strength or the basis weight.

It is theorized that the mode of drying, in particular, can drying, combined with the restriction of movement of the web, and the selective pressing of the web by the carrier fabric are key components of the process to produce a strong web. Drying cans evaporate water in the wetter area of the base web more rapidly than the dryer areas thus reducing moisture variation in the web. With can drying, it is believed that the more uniform moisture in the web produces more uniform drying stresses in the web which, in turn, help produce a more uniform and stronger base web. The web, held or restrained between the knuckles of the fabric and the drying can surface, further controls shrinkage which should also help to make a more uniform web.

Another important result of the can drying process wherein drying is conducted with the web being pressed against the drying can with the knuckled fabric, is the mechanics of what occurs within the web during drying. As will be discussed hereinafter, the increase in web strength properties is felt to be the result of the wet strength resin additive (e.g., polyaminoamide epichlorohydrin) in the furnish migrating to the knuckle points with the fines as the web dries.

With the present invention, it is contemplated that tests may be conducted using a non-substantive dye in the furnish. With the web completely restrained during drying, dye intensity is expected to be greatest where the knuckles of the carrier fabric press the web against the drying can. This would indicate that the largest percentage of water flows to the knuckles where it evaporates. It is believed that the water would flow to the knuckles by either of two mechanisms. The first would be due to the capillary forces which draw water to the knuckles since the web in the knuckled areas has a higher density (finer pores). The second would be the flow of water from the area of the high concentration (loft areas) to areas of lower concentration (knuckles areas). These two phenomena would be expected to cause the water to flow from the low density, non-pressed areas of the web to the higher density, pressed areas of the web, where it evaporates. The flow of water to the knuckle areas may aid in the formation of the densifications in the web.

It is expected that concentrations of the dye in the knuckle areas where the drying fabric would press the web against the drying cans can be achieved as long as the web dryness leaving the Yankee dryer was 60% or less. The intensity of dye at the knuckles is expected to diminish substantially when the web dryness leaving the Yankee dryer is increased above 60%.

With respect to the opposite side of the web (the side of the web away from the surface of the can dryer), the intensity of the dye on this side is expected to increase as the dryness leaving the Yankee dryer is increased. This side of the web would be expected to exhibit much less visible color or dye at 60% dry leaving the Yankee dryer and would exhibit increasing color as the dryness leaving the Yankee dryer increased. This is thought to correspond to less water migrating to the knuckle areas of the web as the web leaving the Yankee dryer became dryer.

From the foregoing, it is generally thought that the chemicals (wet strength resins) will migrate to the knuckle area of the web during can drying. This may be confirmed by conducting iodine vapor adsorption tests on restrained can dried samples. These tests are expected to indicate that the cationic chemical (Kymene 1200) would be concentrated at the knuckled areas of the restrained, can dried web. Experience has shown that iodine concentrates by adsorption where there is the highest electron density. The electron density of the Kymene molecule would indicate that the iodine would probably be adsorbed on the Kymene. Therefore, it is believed that Kymene would be concentrated in the knuckle areas. The migration of the Kymene during restrained, can drying is thought to result in something akin to dot print bonding of the web and would thereby improve the wet strength and have a beneficial impact on the dry strength.

Generally speaking, chemical additives can concentrate at the knuckled areas in two ways. Any chemical additives not tightly bound to the paper fibers can migrate to the knuckle areas as the free water flows to the knuckles were it evaporates. Further, in that it is known that fines will flow in a web as the water flows, the fines concentrate in the finer pores where the knuckles press the web. Because it is known that fines absorb larger amounts of chemicals relative to other paper fibers because of their much larger surface area, the concentration of fines in a knuckled area would also yield a higher concentration of chemical additives in the knuckled areas or densifications.

The mechanics of the migration of Kymene (which is cationic) to the knuckled areas of the web through the practice of the process of the present invention should be practicable with other chemicals added to the furnish. Particularly, any non-ionic or anionic chemical additives or dyes should migrate to the surface of the web where the web contacts the drying cans. Further, such chemical additives and dyes should concentrate in the areas where the knuckles press the web against the drying cans. Examples of chemical additives and dyes found to concentrate in the densifications or knuckled areas include the nonionic dye Turquoise Cibacrone GR (manufactured by Ciba Geigy), FD&C Blue #1 (an anionic dye made by Warner Jenkins), Carta Blue 2GL (an anionic dye made by Sandoz Chemical Co.), and Acco 85 (an anionic dry strength agent produced by Cyanimid.

Tables 1–5 identify data for exemplary wet-creped, imprinted paper webs produced utilizing the method described above. Each table lists a variety of details about paper webs formed from the same furnish. The furnish included about 30% by weight Pictou pulp (available from Kimberly-Clark Corporation) which is composed of about 80% by weight Northern Softwood Kraft pulp and about 20% by weight Northern Hardwood Kraft pulp. The furnish further included about 50% by weight recycled fiber and about 20% by weight chemi-thermomechanical pulp available under the trade designation Tembec CTMP 525 from Tembec Corporation. A conventional wet strength resin, Kymene 1200 (a poly(aminoamide)-epichlorohydrin resin manufactured by Hercules), was added to the wet end in an amount of 1% of the dry fiber weight in the stock chest.

The forming conditions and creping conditions are identified in Tables 1–5 are generally identical or very similar. The tables report variations in web strengths, thickness and other properties for different nip configurations, different after drying fabrics and different nip pressure conditions.

For basis weight data, a 30.5 inch long piece from each sample was folded two times to give eight plies. Four 2.45" by 2.45", single ply basis weight squares were cut from each folded sample. The samples were weighed to determine the basis weight and an average value for the samples wad determined. Basis Weight is expressed in units of lbs. per 2880 square feet (2880 square feet=Ream=rm.) or 1 bs/rm. conditioned at 50% relative humidity and 23 degrees Centigrade for 24 hours.

The thickness of paper samples was measured at a loading of 1 kilopascal (1 kPa). Each sample (either one or two ply)

was composed of 10 webs and was free of creases. The samples were tested utilizing a Thwing-Albert VIR II Thickness Tester utilizing a 39.497 mm (+0.25 mm) diameter circular foot at a pressure of 1 kPa and a dwell time of 3 seconds. The results are expressed as mm/10 webs (as used by the consumer).

Tensile strength values given in Tables 1–5 were measured by a breaking length test (TAPPI Test Method No-T494om-88) using 5.08 cm sample span and 5.08 cm/minute cross head speed. Typically, strengths are different in the machine direction versus cross machine direction of the web. Also, the basis weight of samples may vary. Such variation may affect tensile strength. Accordingly a Geometric Mean Breaking Length (GMBL)was calculated for each sample. GMBL was calculated as the quotient obtained by dividing the basis weight into the square root of the product of the machine direction and cross machine direction tensile strengths. Tensile strengths are measured in both the machine direction and cross machine direction and the basis weight for the tissue sample is measured as described above with all unit chosen to result in meters of braking length.

GMBL (meters)=(MDT*CDT)½/BW

The Total Water Absorbed (TWA) of the samples was determined by measuring the amount of a liquid absorbed by the samples after being submerged in a distilled or deionized water bath at approximately 23° C. and allowed to fully wet out.

More specifically, the absorbency is determined by first cutting a 7.62 mm×7.62 mm specimen of the material to be evaluated, conditioning the specimen at 23° C. and 50% Relative Humidity, and weighing the specimen. This is recorded in units of grams as W1. Two drainage strips should also be cut from the same material.

A wire screen constructed of standard grade reinforced stainless steel wire cloth is lowered into the liquid bath. Using blunt edge tweezers, the specimen is positioned in the liquid bath over the screen and submerged for two minutes. After two minutes, the specimen is positioned over the screen so that it is aligned with the bottom corner of the screen. The screen is raised and the specimen is allowed to drain for a few seconds before the drainage strip is attached. The specimen with attached drainage strip is then clamped to a specimen holder, hung on a rod over a drainage tank and allowed to drain for 30 minutes. Next, the specimen is detached from the specimen holder by releasing the drainage clamps and placed in a weighing tray of a balance. The wet sample is weighed and this weight is recorded in units of grams as W2.

The liquid weight is obtained from the formula:

Liquid Weight=W2−W1

The Total Water Absorbed (TWA) in Grams per Gram is obtained from the formula:

TWA(g/g)=Liquid Weight/W1

From the foregoing, it will be seen that this invention is one well adapted to attain all of the ends and objects herein above set forth together with other advantages which are apparent and which are inherent to the process.

It will be understood that certain features and sub-combinations are of utility and may be employed with references to other features and sub-combinations. This is contemplated by and is within the scope of the claims.

As many possible embodiments may be made of the invention without departing from the scope thereof, it is to be understood that all matter herein set forth were shown in the accompanying drawings as to be interpreted as illustrative and not in a limiting sense.

TABLE 1

| Furnish | % Level | Slush (min.) | Refine (min.) | Freeness (CSF) |
|---|---|---|---|---|
| Pictou (80/20) | 30% | 10.0 | 2.5 | |
| Recycled Fiber | 50% | 10.0 | 2.5 | 525 |
| Tembec CTMP 525 | 20% | 10.0 | 0 | 565 |

Debonder: None @ 0% Level.
Resine: Kymene 1200 @ 1.0% Level. Injection Point: Stock chest.
Yankee Spray: None @ 0% solids: 0 cc/min.: 0 g/m$^2$

| Sample I.D. | 505-1 | 505-2 | 505-3 | | | | |
|---|---|---|---|---|---|---|---|
| Furnish Freeness (CSF) | 555 | | | | | | |
| Headbox Consistency (%) | 0.22 | | | | | | |
| % Wire Retention | 88.5 | | | | | | |
| Yankee Press Roll (psi) | 40.0 | | | | | | |
| Yankee Press Roll (PLI) | 96.0 | | | | | | |
| Yankee Temperature (° F.) | 178° | | 177° | | | | |
| % Crepe Dryness | 57.6 | | 57.1 | | | | |
| Sheet Spray (on/off) | Off | Off | Off | | Off | Off | Off |
| Sheet Spray (cc/min.) | 0 | 0 | 0 | | 0 | 0 | 0 |
| A.D. Fabric No. | Albany 121 | | | LSK. 270 CD Knuckles/ Sanded Area = 9.7% | | | |
| A.D. Temperature (° F.) | 344° | 346° | 344° | | | | |
| A.D. Fabric Temp. (° F.) | 224° | 224° | 222° | | | | |
| A.D. P/R Durometer | 70 | | | ○ → Steel Roll | | | |
| A.D. P/R Load (psig) | 0 | 8 | 15 | ○ → Rubber Roll | | | |
| A.D. P/R Load (PLI) | 3 | 17 | 32 | | | | |
| Yankee Speed (fpm) | 35.0 | | | | | | |
| Reel Speed (fpm) | 29.6 | | | | | | |
| % Crepe | 18.0 | | | | | | |
| B.W. (lb/rm) B.D. | 27.3 | 27.0 | 27.1 | | | | |
| Bulk | 183 | 191 | 208 | | | | |

TABLE 1-continued

| | | | |
|---|---|---|---|
| Bulk/B.W. Ratio | 6.7 | 7.1 | 7.7 |
| MDT (oz/in) | 69.2 | 76.2 | 79.8 |
| MDSTR (%) | 20.9 | 19.8 | 18.5 |
| CDT (oz/in) | 44.7 | 48.6 | 47.6 |
| CDSTR (%) | 3.5 | 3.6 | 3.3 |
| Ratio | 1.5 | 1.5 | 1.6 |
| Total Tensile (oz/in) | 114.0 | 124.9 | 127.4 |
| C-CDWT (oz/in) | 15.5 | 13.8 | 13.6 |
| G.M.B.L. (meters) | 1343 | 1483 | 1495 |
| TWA (g/g) | 2.66 | 2.40 | 2.44 |
| TEA: | | | |
| MD | 7.98 | 8.19 | 7.96 |
| CD | .783 | 1.113 | .963 |
| Tear: | | | |
| MD (gm) | 49.5 | 44.5 | 57.5 |
| CD (gm) | 50.5 | 59.5 | 54.0 |

TABLE 2

| Furnish | % Level | Slush (min.) | Refine (min.) | Freeness (CSF) |
|---|---|---|---|---|
| Pictou (80/20) | 30% | 10.0 | 2.5 | |
| Recycled Fiber | 50% | 10.0 | 2.5 | 525 |
| Tembec CTMP | 20% | 10.0 | 0 | 565 |
| 525 | | | | |

Debonder: None @ 0% Level.

Resine: Kymene 1200 @ 1.0% Level. Injection Point: Stock chest.

Yankee Spray: None @ 0% solids: 0 cc/min.: 0 g/m$^2$

| Sample I.D. | 505-4 | 505-5 | 505-6 | |
|---|---|---|---|---|
| Furnish Freeness (CSF) | 555 | | | |
| Headbox Consistency (%) | 0.24 | | | |
| % Wire Retention | 87.9 | | | |
| Yankee Press Roll (psi) | 40.0 | | | |
| Yankee Press Roll (PLI) | 96.0 | | | |
| Yankee Temperature (° F.) | 178° | | | |
| % Crepe Dryness | 58.2 | | | |
| Sheet Spray (on/off) | Off | Off | Off | |
| Sheet Spray (cc/min.) | 0 | 0 | 0 | |
| | | | | Unsanded. LSK. |
| A.D. Fabric No. | Asten Hill 36-F: New | | | Contact Area = 5.4% |
| A.D. Temperature (° F.) | | | | |
| A.D. Fabric Temp. (° F.) | | | | |
| A.D. P/R Durometer | 70 | | ○ → Steel Roll | |
| A.D. P/R Load (psig) | 0 | 8 | 15 | ○ → Rubber Roll |
| A.D. P/R Load (PLI) | 3 | 17 | 32 | |
| Yankee Speed (fpm) | 35.0 | | | |
| Reel Speed (fpm) | 29.6 | | | |
| % Crepe | 18.0 | | | |
| B.W. (lb/rm) B.D. | 26.2 | 26.1 | 27.2 | |
| Bulk | 212 | 225 | 230 | |
| Bulk/B.W. Ratio | 7.3 | 8.6 | 8.6 | |
| MDT (oz/in) | 72.0 | 74.7 | 63.0 | |
| MDSTR (%) | 18.0 | 18.8 | 15.8 | |
| CDT (oz/in) | 42.0 | 49.8 | 43.6 | |
| CDSTR (%) | 3.6 | 4.1 | 4.3 | |
| Ratio | 1.7 | 1.5 | 1.4 | |

TABLE 2-continued

| | | | |
|---|---|---|---|
| Total Tensile (oz/in) | 114.0 | 124.6 | 106.5 |
| C-CDWT (oz/in) | 13.1 | 12.7 | 14.1 |
| G.M.B.L. (meters) | 1380 | 1540 | 1280 |
| TWA (g/g) | 2.97 | 2.55 | 2.65 |
| TEA: | | | |
| MD | 7.64 | 8.31 | 6.13 |
| CD | .925 | 1.31 | 1.125 |
| Tear: | | | |
| MD (gm) | 55.5 | 40.0 | 46.5 |
| CD (gm) | 48.5 | 46.0 | 48.0 |

TABLE 3

| Furnish | % Level | Slush (min.) | Refine (min.) | Freeness (CSF) |
|---|---|---|---|---|
| Pictou (80/20) | 30% | 10.0 | 2.5 | |
| Recycled Fiber | 50% | 10.0 | 2.5 | 520 |
| Tembec CTMP | 20% | 10.0 | 0 | 565 |
| 525 | | | | |

Debonder: None @ 0% Level.
Resine: Kymene 1200 @ 1.0% Level. Injection Point: Stock chest.
Yankee Spray: None @ 0% solids: 0 cc/min.: 0 g/m$^2$

| Sample I.D. | 506-1 | 506-2 | 506-3 | |
|---|---|---|---|---|
| Furnish Freeness (CSF) | 550 | | | |
| Headbox Consistency (%) | .21 | | | |
| % Wire Retention | 88.2 | | | |
| Yankee Press Roll (psi) | 40.0 | | | |
| Yankee Press Roll (PLI) | 96.0 | | | |
| Yankee Temperature (° F.) | 180° | | 181° | |
| % Crepe Dryness | 57.7 | | 58.0 | |
| Sheet Spray (on/off) | Off | Off | Off | |
| Sheet Spray (cc/min.) | 0 | 0 | 0 | |
| | | | | Unsanded. LSK. |
| A.D. Fabric No. | Asten Hill 36-F: New | | | Contact Area = 5.4% |
| A.D. Temperature (° F.) | 321° | | 325° | |
| A.D. Fabric Temp. (° F.) | 174° | | 170° | |
| A.D. P/R Durometer | 70 | | | ○ → Rubber Roll |
| A.D. P/R Load (psig) | 0 | 8 | 15 | ○ → Steel Roll |
| A.D. P/R Load (PLI) | 3 | 17 | 32 | |
| Yankee Speed (fpm) | 35.0 | | | |
| Reel Speed (fpm) | 29.6 | | | |
| % Crepe | 18.0 | | | |
| B.W. (lb/rm) B.D. | 26.9 | 26.9 | 27.3 | |
| Bulk | 201 | 215 | 218 | |
| Bulk/B.W. Ratio | 7.4 | 7.9 | 7.9 | |
| MDT (oz/in) | 86.9 | 86.5 | 83.0 | |
| MDSTR (%) | 21.4 | 18.6 | 27.8 | |
| CDT (oz/in) | 57.5 | 55.3 | 54.0 | |
| CDSTR (%) | 3.3 | 3.7 | 3.9 | |
| Ratio | 1.5 | 1.5 | 1.5 | |
| Total Tensile (oz/in) | 144.5 | 142.0 | 137.0 | |
| C-CDWT (oz/in) | 16.1 | 17.7 | 18.1 | |
| G.M.B.L. (meters) | 1729 | 1690 | 1610 | |
| TWA (g/g) | 2.65 | 2.60 | 2.63 | |
| TEA: | | | | |
| MD | 10.75 | 9.09 | 12.04 | |
| CD | 1.23 | 1.31 | 1.34 | |
| Tear: | | | | |
| MD (gm) | 58.5 | 62.5 | 61.0 | |
| CD (gm) | 57.0 | 57.0 | 52.0 | |

TABLE 4

| Furnish | % Level | Slush (min.) | Refine (min.) | Freeness (CSF) |
|---|---|---|---|---|
| Pictou (80/20) | 30% | 10.0 | 2.5 | |
| Recycled Fiber | 50% | 10.0 | 2.5 | 520 |
| Tembec CTMP | 20% | 10.0 | 0 | 565 |
| 525 | | | | |

Debonder: None @ 0% Level.
Resine: Kymene 1200 @ 1.0% Level. Injection Point: Stock chest.
Yankee Spray: None @ 0% solids: 0 cc/min.: 0 g/m$^2$

| Sample I.D. | 5009-1 | 5009-2 | 5009-3 | |
|---|---|---|---|---|
| Furnish Freeness (CSF) | 550 | | | |
| Headbox Consistency (%) | | | | |
| % Wire Retention | | | | |
| Yankee Press Roll (psi) | 40.0 | | | |
| Yankee Press Roll (PLI) | 96.0 | | | |
| Yankee Temperature (° F.) | | | | |
| % Crepe Dryness | | | | |
| Sheet Spray (on/off) | Off | Off | Off | |
| Sheet Spray (cc/min.) | 0 | 0 | 0 | |
| | | | | LSK. 270 CD Knuckles/in$^2$ |
| A.D. Fabric No. | Albany 121(P&G) | | | Sanded area = 9.7% |
| A.D. Temperature (° F.) | | | | |
| A.D. Fabric Temp. (° F.) | | | | |
| A.D. P/R Durometer | 70 | | ○ → Rubber Roll | |
| A.D. P/R Load (psig) | 0 | 8 | 15 ○ → Steel Roll | |
| A.D. P/R Load (PLI) | 3 | 17 | 32 | |
| Yankee Speed (fpm) | 35.0 | | | |
| Reel Speed (fpm) | 29.6 | | | |
| % Crepe | 18.0 | | | |
| B.W. (lb/rm) B.D. | 26.3 | 28.4 | 29.2 | |
| Bulk | 192 | 196 | 197 | |
| Bulk/B.W. Ratio | 7.3 | 6.9 | 6.7 | |
| MDT (oz/in) | 80.3 | 79.6 | 79.0 | |
| MDSTR (%) | 21.0 | 21.0 | 23.8 | |
| CDT (oz/in) | 46.5 | 60.6 | 63.3 | |
| CDSTR (%) | 2.8 | 2.2 | 2.5 | |
| Ratio | 1.7 | 1.3 | 1.3 | |
| Total Tensile (oz/in) | 126.8 | 140.2 | 142.3 | |
| C-CDWT (oz/in) | 13.3 | 16.7 | 20.2 | |
| G.M.B.L. (meters) | 1529 | 1606 | 1592 | |
| TWA (g/g) | 2.62 | 2.36 | 2.44 | |
| TEA: | | | | |
| MD | 10.54 | 10.31 | 11.58 | |
| CD | .79 | .827 | 1.00 | |
| Tear: | | | | |
| MD (gm) | 53.0 | 42.5 | 46.0 | |
| CD (gm) | 67.0 | 64.0 | 61.5 | |

TABLE 5

| Furnish | % Level | Slush (min.) | Refine (min.) | Freeness (CSF) |
|---|---|---|---|---|
| Pictou (80/20) | 30% | 10.0 | 2.5 | |
| Recycled Fiber | 50% | 10.0 | 2.5 | 525 |
| Tembec CTMP | 20% | 10.0 | 0 | 565 |
| 525 | | | | |

Debonder: None @ 0% Level.
Resine: Kymene 1200 @ 1.0% Level. Injection Point: Stock chest.
Yankee Spray: None @ 0% solids: 0 cc/min.: 0 g/m$^2$

| Sample I.D. | 5010-1 | 5010-2 | 5010-3 |
|---|---|---|---|
| Furnish Freeness (CSF) | 555 | | |
| Headbox Consistency (%) | | | |
| % Wire Retention | | | |
| Yankee Press Roll (psi) | 40.0 | | |
| Yankee Press Roll (PLI) | 96.0 | | |

TABLE 5-continued

| | | | | |
|---|---|---|---|---|
| Yankee Temperature (° F.) | | | | |
| % Crepe Dryness | | | | |
| Sheet Spray (on/off) | Off | Off | Off | |
| Sheet Spray (cc/min.) | 0 | 0 | 0 | |
| A.D. Fabric No. | Asten Hill 36-F: New. | | | Unsanded. LSK. Contact area = 5.4% |
| A.D. Temperature (° F.) | | | | |
| A.D. Fabric Temp. (° F.) | | | | |
| A.D. P/R Durometer | | | | |
| A.D. P/R Load (psig) | 0 | 8 | 15 | |
| A.D. P/R Load (PLI) | 3 | 17 | 32 | |
| Yankee Speed (fpm) | 35.0 | | | |
| Reel Speed (fpm) | 29.6 | | | |
| % Crepe | 18.0 | | | |
| B.W. (lb/rm) B.D. | 28.4 | 28.1 | 29.7 | |
| Bulk | 216 | 225 | 212 | |
| Bulk/B.W. Ratio | 7.6 | 8.0 | 7.1 | |
| MDT (oz/in) | 80.4 | 84.0 | 97.8 | |
| MDSTR (%) | 21.4 | 17.9 | 17.8 | |
| CDT (oz/in) | 46.9 | 44.2 | 57.6 | |
| CDSTR (%) | 3.0 | 3.6 | 3.3 | |
| Ratio | 1.7 | 1.9 | 1.7 | |
| Total Tensile (oz/in) | 127.3 | 128.2 | 155.4 | |
| C-CDWT (oz/in) | 14.2 | 12.3 | 17.7 | |
| G.M.B.L. (meters) | 1422 | 1428 | 1661 | |
| TWA (g/g) | 2.81 | 2.35 | 2.64 | |
| TEA: | | | | |
| MD | 9.73 | 8.61 | 10.17 | |
| CD | .961 | 1.09 | 1.36 | |
| Tear: | | | | |
| MD (gm) | 41.5 | 52.0 | 41.0 | |
| CD (gm) | 66.0 | 62.0 | 68.5 | |

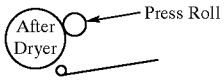

I claim:

1. A process of making a low density, wet-creped paper web having improved levels of tensile strength, tear strength and thickness, comprising:

removing a wet-creped paper web from a Yankee dryer at a dryness of between 45 and 65%;

pressing the wet-creped paper web into an after dryer fabric to transfer the topography of the after dryer fabric utilizing a nip before the web is 70% dry; and maintaining the wet-creped paper web on the drying fabric without any change in the registration between the wet-creped web and the drying fabric until the wet-creped web is at least about 80% dry.

2. The process of claim 1, wherein the wet-creped paper web is removed from a Yankee dryer at a dryness ranging from about 50 to about 60%.

3. The process of claim 1, wherein wet-creped paper web is pressed into the after-dryer fabric utilizing a nip at a web dryness ranging from about 50 to about 60%.

4. The process of claim 1, wherein the pressing step is accomplished utilizing a hard press roll that is backed by a soft roll such that the hard press roll contacts the after-dryer fabric and presses the after-dryer fabric into the base web which is backed or supported by the soft roll.

5. The process of claim 4, wherein the hard press roll is a steel roll and the soft roll is a rubber roll.

6. The process of claim 4, wherein the pressing step is carried out so the load on the rolls is sufficient to produce a pressure at the nip of from about 10 to about 400 pounds per square inch.

7. The process of claim 6, wherein the pressing step is carried out so that the load on the rolls is sufficient to produce a pressure at the nip of from about 15 to about 100 pounds per linear inch.

8. The process of claim 6, wherein the pressing step is carried out so the load on the rolls is sufficient to produce a pressure at the nip of from about 20 to about 50 pounds per linear inch.

9. The process of claim 1, wherein a soft press roll contacts the after-dryer fabric and presses the after-dryer fabric into the base web which is backed or supported by a hard roll.

10. The process of claim 1, wherein a soft press roll contacts the after-dryer fabric and presses the after-dryer fabric into the base web which is supported by a drying can.

11. The process of claim 10, wherein the drying can is selected from a Yankee dryer, heated drum, steam can and combinations thereof.

12. The process of claim 1, wherein wet-creped paper web remains on the drying fabric until it is about 95% dry.

* * * * *